United States Patent [19]

Manning

[11] Patent Number: 4,807,748

[45] Date of Patent: Feb. 28, 1989

[54] ATTACHABLE CONTAINER RISER

[75] Inventor: Douglas E. Manning, Knoxville, Tenn.

[73] Assignee: Phelps Engineering Company, Inc., Knoxville, Tenn.

[21] Appl. No.: 129,966

[22] Filed: Dec. 4, 1987

Related U.S. Application Data

[63] Continuation-in-part of Ser. No. 885,226, Jul. 14, 1986, abandoned.

[51] Int. Cl.[4] ..... B65D 19/00

[52] U.S. Cl. ..... 206/386; 206/599; 108/153; 108/156

[58] Field of Search ..... 206/386, 599, 821; 108/153, 155, 156, 157, 158, 902, 26, 51.1, 53.1, 54.1; D9/341, 345, 348

[56] References Cited

U.S. PATENT DOCUMENTS

| | | | |
|---|---|---|---|
| 1,652,905 | 12/1927 | McMahon | 108/51.1 |
| 2,252,272 | 8/1941 | Otto | 206/821 |
| 2,593,998 | 4/1952 | Dupuis | 206/821 |
| 2,675,767 | 4/1954 | Davie | 108/51.1 |
| 2,930,481 | 3/1960 | Bebie | 108/51.1 |
| 3,101,063 | 11/1960 | Wharton | 108/51.1 |
| 3,130,692 | 4/1964 | Burk et al. | 108/156 |
| 3,236,197 | 2/1966 | Rossner | 108/51.3 |
| 3,567,068 | 3/1971 | Carfizzi | 108/51.1 |
| 3,797,727 | 3/1974 | Downing et al. | 108/55.1 |
| 3,957,268 | 5/1976 | Silberman | 108/157 |
| 4,445,614 | 5/1984 | Mitsumori et al. | 108/53.1 |

FOREIGN PATENT DOCUMENTS

| | | | |
|---|---|---|---|
| 2092110 | 8/1982 | United Kingdom | 206/599 |

*Primary Examiner*—David T. Fidei

[57] ABSTRACT

An attachable riser used in material handling is held in place by spring clips. At least two such risers are attached to the underside of an object allowing clearance for the forks of a machine such as a forktruck to move under the object. When the object is picked up, moved, and set down the risers remain attached to the object thus eliminating the manual moving or placement of ordinary risers such as timbers. The risers are easily removed from the object when desired.

6 Claims, 3 Drawing Sheets

ATTACHABLE CONTAINER RISER

This is a continuation in part of Ser. No. 06/855,266, filed July 14, 1986, now abandoned.

BACKGROUND OF THE INVENTION

1. Field of the Invention

The present invention relates to risers used in material handling, and more particularly to an attachable riser held in place by spring clips.

2. Description of the Prior Art

A common method for material handling is to use a machine such as a forktruck which picks up objects by means of two metal forks. It is necessary to raise the object sufficiently to locate the forks underneath the object to be picked up. A method for accomplishing this is to place the object on a pallet that is constructed to allow clearance for the forks. The pallet and object are picked up and moved simultaneously.

Larger objects of a size that will not fit satisfactorily on a pallet may be placed on metal or wooden timbers known as risers which physically raise the object to allow fork clearance. It is necessary to move these type of risers separately as they are not picked up with the object. This usually entails a second person other than the forktruck operator, or requires the operator to dismount the fork truck to move the risers.

The present invention offers improvements for this type of operation by reducing the total amount of required handling.

SUMMARY OF THE INVENTION

According to the present invention, the cumbersome separate moving of ordinary risers is eliminated for some applications by allowing them to be temporarily attached to the object and easily removed when no longer required. The attachable risers may be constructed from wood, metal, or any suitable material of sufficient strength to support the object being moved. The risers may be attached manually to an object while it is picked up or by setting the object down onto the risers. When the object is set down, its weight is supported by the risers and it is also physically raised an amount sufficient to allow clearance for the forks of a forktruck to be located underneath.

A spring clip is fixed at each end of the riser in a location that will enable it to fit to the object being moved. The spring clips may be fabricated from metal, plastic, or other suitable material and need only to be strong enough to hold the weight of the riser as it is moved with the object. The spring clips apply equal opposing forces to the object that in turn generate a vertical force that will support the weight of the attachable riser. The spring clip on one end of the riser may be replaced by a simple abutment. A suitable object that can make use of the invention must be constructed from material strong enough to withstand the required spring force.

The invention as described effectively reduces the total amount of handling required and is particularly advantageous when moving many objects of like construction that cannot be supported on a standard pallet.

DETAILED DESCRIPTION

Figure 1:
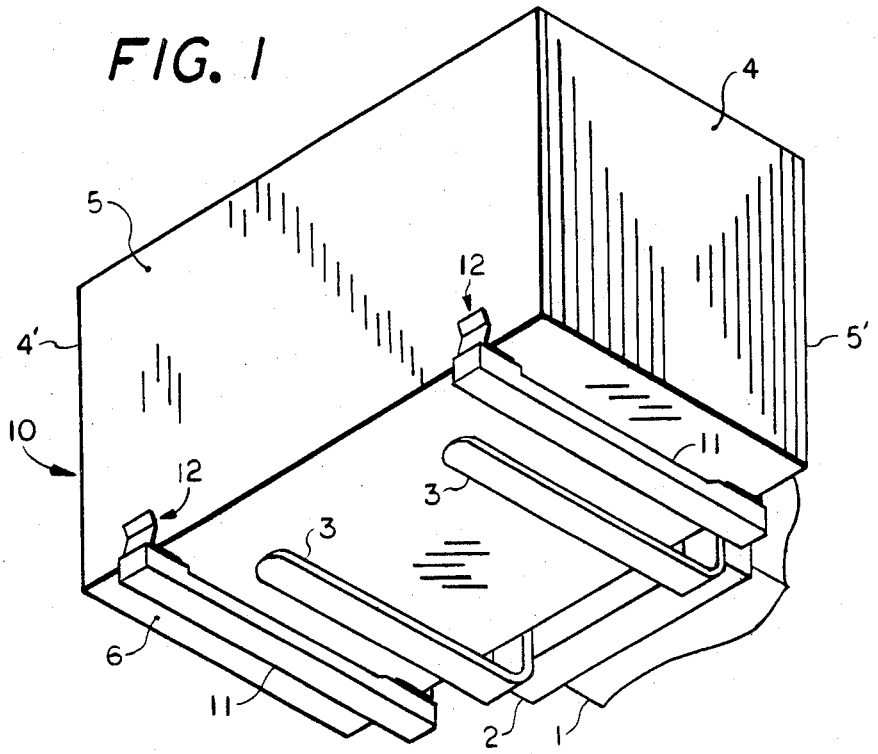
FIG. 1 is a bottom perspective view of an object being supported by the forks of a forktruck and having two attachable riser assemblies in place.
Figure 2:
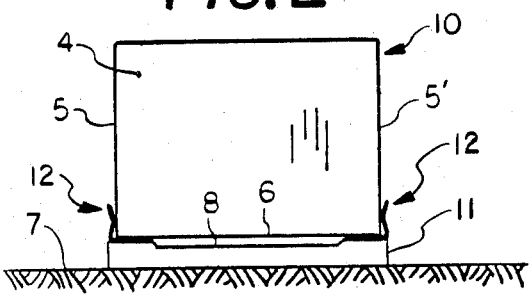
FIG. 2 is a side elevational view illustrating an attachable riser supporting the object of FIG. 1 when placed on a surface.

With reference to FIG. 1 the present invention is implemented on a box type object 10, such as a container, being supported by two forks 3 that are attached to a support carriage 2 of standard commercial forktruck 1 illustrated here as a part section. The object 10 has a bottom 6, and a plurality of oppositely opposed upright sides 5, 5', 4, 4' that clips 12 may attach to. Two riser assemblies 11, 12 are illustrated underneath the object 10 as being attached to the oppositely opposing upright sides 5, 5'. The object 10 may be constructed of wood, metal, plastic, or any suitable material that will withstand the attaching force of the spring clips 12. FIG. 2 illustrates how the object 10 would appear when placed on a surface 7 and supported by the riser assemblies 11, 12 instead of the forks 3 as illustrated in FIG. 1.

Figure 6:
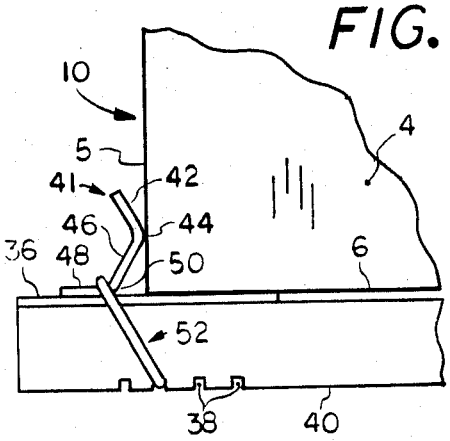
FIG. 6 is a side elevational view of an alternative clip arrangement having an adjustable mounting bracket.
Figure 7:
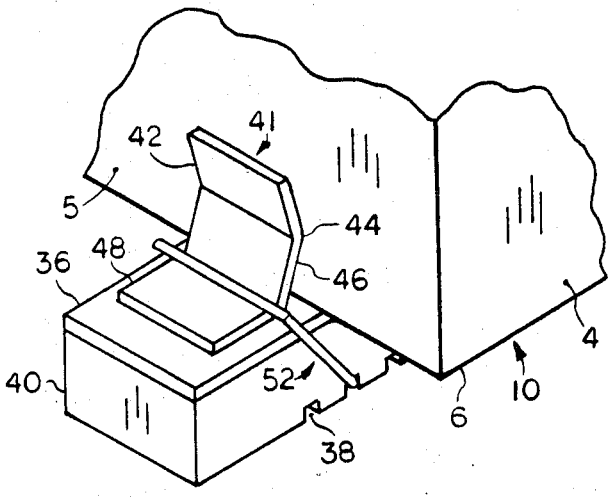
FIG. 7 is a top perspective view illustrating the alternative clip arrangement of FIG. 6.
Figure 9:
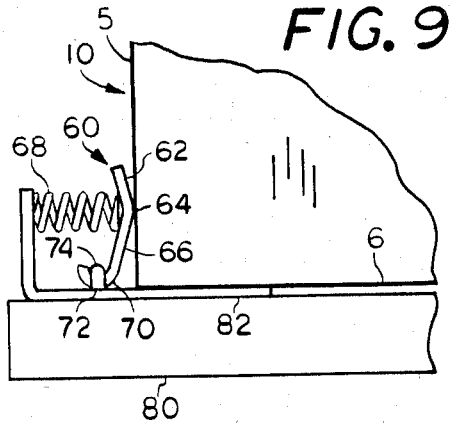
FIG. 9 is a side elevational view of an alternative clip arrangement using a coiled compression spring to achieve the attaching force for the cantilevered spring function.
Figure 10:
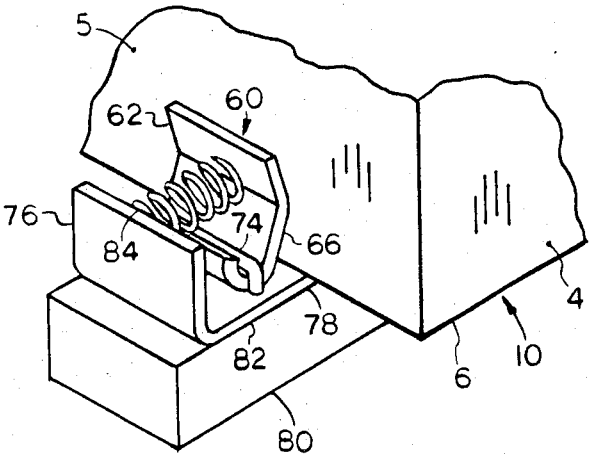
FIG. 10 is a top perspective view illustrating the alternative clip arrangement of FIG. 9.
Figure 11:
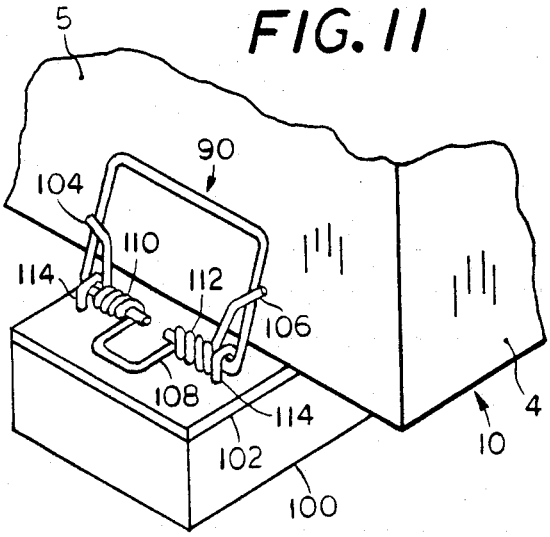
FIG. 11 is a top perspective view of an alternative clip arrangement using a coiled torsion spring to achieve the attaching force for the cantilevered spring function.

The riser 11 material may be constructed of any material such as wood, metal, plastic or a composite that will support the weight of the object 10. The spring clips 12 may also be fabricated from various materials such as metal, plastic or a composite and are fixed to the risers 11 by any suitable means 9, illustrated by FIG. 3, such as glue, nails, welds, screws, rivets, etc. to form the attachable riser assembly 11, 12. No specific technique of fixing the spring clips 12 to the risers 11 is shown in the drawing FIGS. 1–3. The spring clips my be constructed from flat sheets as illustrated by FIGS. 3, 6, and 7; round bars using a torsion spring as illustrated by FIG. 11; or may be a two part coiled spring-plate arrangement as illustrated by FIGS. 9–10.

Figure 3:
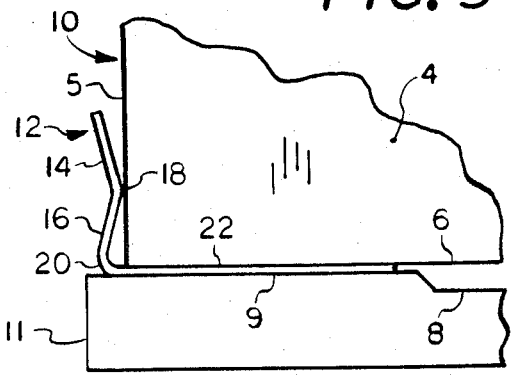
FIG. 3 is a side elevational view of the spring clip interface to the object of FIG. 1.

With reference to FIG. 3 the spring clip 12 is shaped to allow attachment by raising the riser assembly 11, 12 to the object 10 from underneath the picked up object 10 or by lowering the object 10 onto the riser assembly 11, 12. The top edge of the spring clip 12 is bent away from the side 5 of the object 10 to a total distance between the top edges of the two spring clips 12 as seen in FIG. 2 that is larger than the width of the object 10. This allows the riser assembly 11, 12 to start onto the object 10 with no interference. The top angle of the spring clip 12 is such that a wedge is formed between both spring clips 12 and the object 10 when the object 10 is brought closer to the riser assembly 11, 12. The distance between the contacting bends 18 of the two spring clips 12 is less than the width of the object 10 by an amount that will deflect the spring clips 12 outward causing a force to be applied to the surface of the object 10.

Also noted in FIG. 3 the clip 12 is formed from a single flat sheet having two bends 18, 20 to give the cantilevered sections 14, 16, and support section 22. Deflection of the bend 20 causes most of the spring force that is transferred through the contact point at the bend 18 to the object side 5.

The spring clips 12 are sized and located onto the riser 11 so as to cause a vertical friction force between the spring clips 12 and the object 10 that is of an amount greater than the weight of the riser assembly 11, 12. This friction force allows the riser assembly to remain attached to the object 10 when it 10 is picked up and moved. The shape of the object 10 may also be such that would allow the bend 18 of the spring clips 12 to rest in a recess of the object 10 thus causing the required vertical force other than by friction but still dependent on the spring force of the clips 12.

Figure 4:
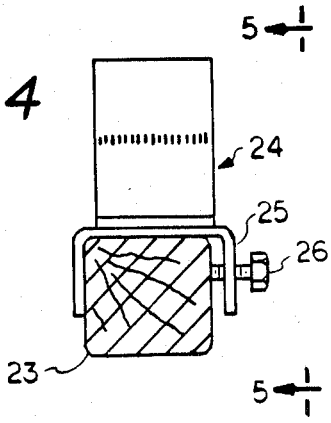
FIG. 4 is an end elevational view of a spring clip with an alternative adjustable mounting bracket.
Figure 5:
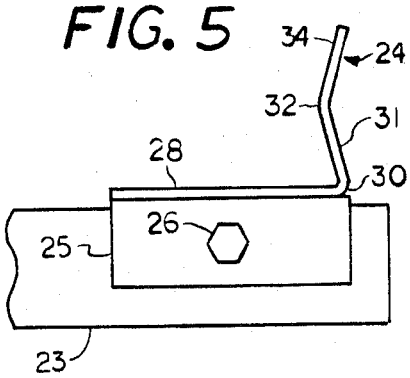
FIG. 5 is a side elevational view taken from FIG. 4 and illustrates the spring clip with an adjustable mounting bracket.

In FIG. 3 the lower part 22 of the spring clip 12 is shown bent horizontal and attached to the top of the riser 11 by means 9. The same effect is achieved by bending to allow a vertical attachment to the end of the riser 11 or by bending to a horizontal attachment to the bottom of the riser 11. FIGS. 4–5 show a spring clip 24 attachment as it could appear using an adjustable mount technique for the spring clip 24 onto a riser 23. An additional member 25 can slide over the riser 23 and be locked in place with the bolt 26 that is threaded through 25. Members 28, 30, 31, 32, and 34 in FIGS. 4–5 have an identical function as the FIG. 3 members 22, 20, 16, 18, and 14 respectively.

Figure 8:
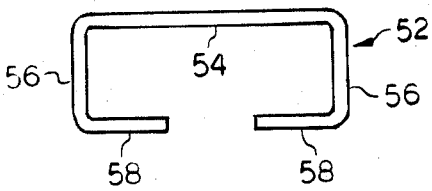
FIG. 8 is a front elevational view illustrating the adjusting bracket of FIGS. 6–7.

FIGS. 6–8 illustrate an alternative embodiment of a clip 41 arrangement with an adjustable mounting bracket 52 that locks in place to the elongated support member 40 by means of notches 38 cut in the bottom of member 40. The cantilevered members 46, 42 and horizontal member 48 are formed from a flat sheet having bends 50, 44. Bend 44 is also the contact point to the side 5 of the same object 10 as was illustrated in FIG. 1. When bend 50 deflects, it causes a spring force to be transmitted to the contact point at bend 44 allowing the riser assembly 40, 41 to remain attached to the object 10 very similarly to the clip 12 illustrated by FIG. 3. Members 36, 40 and 48 need not have additional attachment means between them, but are held in place by the bracket 52 and the force through the contact point at bend 44. When the riser assembly 40, 41 is not attached to the object 10, the clip 41 will remain in place if the width of the notch 38 has been sized to provide a light press fit with the bracket 52. FIG. 8 illustrates how the bracket 52 could be made as from a round bar bent to form members 54, 56, 58.

FIGS. 9–10 illustrate an alternative embodiment of a clip arrangement 60 that derives the required attaching spring force from a coiled compression spring 68 rather than relying on the bend 20 shown in FIG. 3. The combination of forces between the spring 68 and support members 62, 66, 76, 78, and 80 form an identical cantilevered spring function as that illustrated by FIG. 3. The contact point is the bend 64 with the side 5 of the object 10. The bend 70 pivots on member 74 having attaching means 72 to member 78. The advantage of this embodiment is that the desired attaching function can be achieved with a larger horizontal movement of the contact point at bend 64. Member 78 may have identical attaching means 82 as that used in FIG. 3 to include an adjustable mount such as illustrated by FIG. 5.

FIG. 11 illustrates an alternative embodiment of a clip 90 arrangement being attached to the same object 10 illustrated by FIG. 1. The required spring force is achieved by means of a torsion spring illustrated as being formed from a, wire, round rod, or the like to form members 104, 106, 108, 110, and 112 that in combination with members 90, 100, 114 form a cantilevered spring very similar in function to FIG. 3. The coils 110, 112 serve the same function as the bend 20 of FIG. 3. The assembly may have a spacer 102 on top of the elongated support member 100 and is illustrated as having attachment means 114, such as a metal staple, that can also serve as a pivot for the cantilevered spring combination. The primary advantage of this embodiment is that the members can easily be sized to allow a larger horizontal movement of the contact point than can either the embodiments of FIGS. 3, 7, 10.

Figure 12:
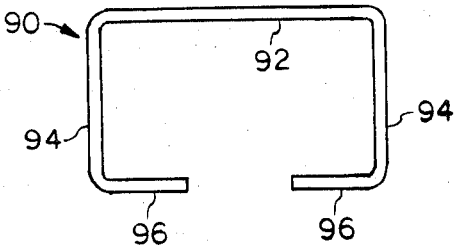
FIG. 12 is a front elevational view of the cantilevered clip member of FIG. 11.
Figure 13:
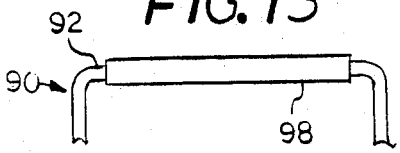
FIG. 13 is a modification of the clip member of FIG. 12 and illustrates a technique for adding material to the cantilevered clip to achieve better gripping and protection of the object surface.

FIG. 12 illustrates the cantilevered member 90 of the cantilevered spring arrangement of FIG. 11, and is shown as being formed from a wire, round rod, or the like to form members 92 ,94, 96. Member 92 is also the contact point when formed as shown. An additional member 98, can be added to member 92 as illustrated by FIG. 13. Member 98 can be made of material such as a rubber tube, plastic or the like to achieve better frictional gripping and protection of the side 5 of the object 10 at the contact point.

Figure 14:
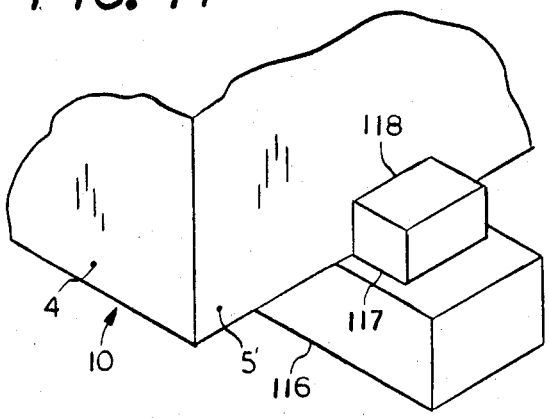
FIG. 14 is a top perspective view of an abutment that can be used to replace a spring loaded clip on one end of the riser.
Figure 15:
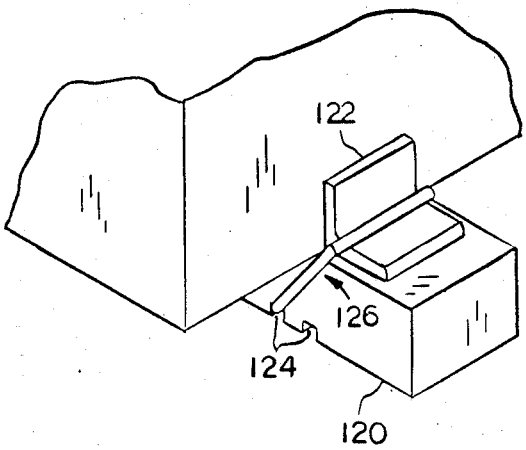
FIG. 15 is a top perspective view of an abutment having an adjustable mounting bracket similar to FIG. 8.

FIG. 14 illustrates a top perspective view of an abutment 118 that can be placed on the end of the elongated support member 116 opposite to the end having a cantilevered spring of one of the types described above. The force seen by the abutment 118 from the containers wall 5' is the same as that placed on the oppositely opposed object wall 5. The advantages of using an abutment 118 instead of a cantilevered spring are that the attaching force is doubled from that seen when using two identical cantilevered springs and a simpler less expensive member is used. The disadvantage is that the available horizontal travel is one-half that available from using two identical cantilevered springs of the types previously described. The abutment 118 may have attaching means 117 to the member 100 by any of the previously described means for the above cantilevered spring types. FIG. 15 illustrates an abutment 122 made from a structural angle that is attached to the elongated support member 120 by a movable bracket 126 that is similar in fabrication to the bracket 52 illustrated by FIG. 8. The notches 124 shown have the same function as the notches 38 of FIG. 6–7. The abutment could also be mounted to the member 25 shown by FIGS. 4–5.

Figure 16:
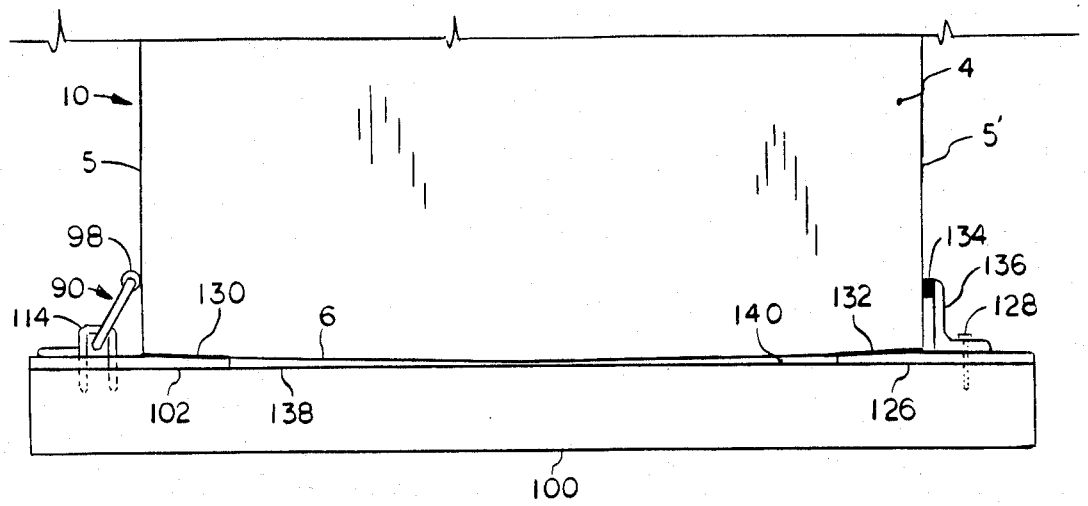
FIG. 16 is an end elevational view of the lower part of the object of FIG. 1 having a riser attached with the clip of FIG. 11 and a structural angle abutment. Material is shown which enables better gripping and protection of the side of the object. The deflection of the bottom of the object is also illustrated.

FIG. 16 illustrates a lower part of the object 10 of FIG. 1 having a riser attached 114 with the clip of FIG. 11–13 and a structural angle abutment 136 having attaching means 128 such as a nail. Material 134 is shown which enables better gripping and protection of the side 5' of the object 10.

A typical deflection of the bottom 6 of the object 10 also illustrated by FIG. 16 as a gradual downward bow of the bottom 6. Normally this bow would cause the elongated support member 100 to contact the bottom 6 at one point only and not necessarily at the object 10 center. Member 100 would then tend to roll along this bow with the end with the smallest spring coefficient being forced off the side of the object. To prevent this from occurring, clearance 140 between the bottom 6 of the object 10 and the top of the elongated support member 100 is provided. The clearance 140 need only be enough to allow for the expected deflection of the object 10, for example a typical deflection may be ¼ inch thus clearance of at least this amount should be provided. While the top of the member 100 could be cutout with a bow to match that of the bottom 6, this would normally be too expensive and the same effect can be accomplished by using a straight in lieu of a bowed cutout to provide clearance 140 at the member 100 center portion. The member 100 will then support the object 10 by contacting at the surfaces 130, 132 near each opposing sides 5, 5' and will not tend to become disengaged from the object 10 as a result of the described deflection.

The required clearance 140 can also be easily obtained by placing spacers 102, 126 at the member 100 ends of a thickness at least equal to the expected bow. Figs. 6–7 illustrate such a spacer 36. FIGS. 9–10 use member 78 as both a spacer and means for mounting the cantilevered spring assembly. FIG. 5 achieves the clearance by the top surface of member 28.

In FIGS. 1–3 the riser 11 is shown with the top 8 cutout to allow the object 10 to deflect due to its own weight without interfering with the spring clip attachments 12. When the rigidity of the object 10 is such that this deflection causes no interference then the top 8 cutout of the riser 11 may be omitted.

From the foregoing description of the operation of the attachable riser, it should be apparent that an technique is provided which effectively reduces the amount of handling required over ordinary non-attachable risers when moving objects of the type that allow use of the invention.

Having illustrated and described what is presently the preferred embodiments of the invention, it should be apparent to those skilled in the art that the preferred embodiments may be modified in arrangement and detail without departing from the principles of the invention which are intended to be revealed but not limited by the disclosure. We therefore claim as our invention all such modifications as come within the true spirit and scope of the following claims:

We claim:

1. A material handling system having means for attaching a riser assembly to an object, said object having a bottom and a plurality of oppositely opposed upright sides, said material handling system comprising:

a plurality of elongated support members located underneath said object, each of said support members having a first and second end portion;

a plurality of clips each attached to said first and second end portion of said support members, each clip having one end rigidly attached to said support member and a free end extending generally perpendicular to said support member, each of said clips forming a cantilevered spring on top of said support members for exerting force against the side of said object thereby allowing attachment of said support members to said object;

means for allowing deflection of the bottom of said object comprising clearance along the top portion of the midlength of said support members and;

mounting means for attaching said clips upon said support members.

2. A material handling system as described in claim 1 wherein said mounting means comprises a movable bracket with means for locking said bracket in place at various locations thereof to facilitate attachment to objects of differing dimensions.

3. A material handling system having means for attaching a riser assembly to an object, said object having a bottom and a plurality of oppositely opposed upright sides, said material handling system comprising:

a plurality of elongated support members located underneath said object, each of said support members having a first and second end portion;

a plurality of abutments each attached to said first end portion of said support members, each abutment having one end rigidly attached to said support member and a free end extending generally perpendicular to and on top of said support members for exerting force against the side of said object;

a plurality of clips each attached to said second end portion of said support members, each clip having one end rigidly attached to said support member and a free end extending generally perpendicular to said support member, each of said clips forming a cantilevered spring on top of said support members for exerting force against the side of said object thereby allowing attachment of said support members to said object;

means for allowing deflection of the bottom of said object comprising clearance along the top portion of the midlength of said support members;

mounting means for attaching said abutments upon said support members and;

mounting means for attaching said clips upon said support members.

4. A material handling system as described in claim 3 wherein said mounting means for attaching said abutments upon said support members comprises a movable bracket with means for locking said bracket in place at various locations thereof to facilitate attachment to objects of differing dimensions.

5. A material handling system as described in claim 3 wherein said mounting means for attaching said clips upon said support members comprises a movable bracket with means for locking said bracket in place at various locations thereof to facilitate attachment to objects of differing dimensions.

6. A material handling system as described in claim 1 or 3 in combination with a substantially box shaped container.

* * * * *